United States Patent [19]

Edwards et al.

[11] Patent Number: 4,859,971

[45] Date of Patent: Aug. 22, 1989

[54] R-SEGMENT TRANSMISSION LINE DIRECTIONAL COUPLER

[75] Inventors: Richard C. Edwards; Burton L. Martin, both of Cedar Rapids, Iowa

[73] Assignee: Rockwell International Corporation, El Segundo, Calif.

[21] Appl. No.: 39,570

[22] Filed: Apr. 15, 1987

[51] Int. Cl.[4] ..... H01P 5/18

[52] U.S. Cl. ..... 333/109; 333/115

[58] Field of Search ..... 333/109, 112, 115, 117, 333/123, 116, 243

[56] References Cited

U.S. PATENT DOCUMENTS

| | | | |
|---|---|---|---|
| 2,576,979 | 12/1951 | Thompson | 333/109 X |
| 2,763,777 | 9/1956 | Smullin | 333/115 X |
| 3,577,099 | 5/1971 | Hall et al. | 333/115 X |
| 4,011,529 | 3/1977 | Garcia | 333/115 |
| 4,013,981 | 3/1977 | Shintani et al. | 333/116 X |
| 4,591,813 | 5/1986 | Miletic | 333/123 X |

*Primary Examiner*—Paul Gensler

*Attorney, Agent, or Firm*—M. Lee Murrah; V. Lawrence Sewell; H. Fred Hamann

[57] ABSTRACT

A 20 to 500 MHz directional coupler for use in a high power RF system uses a pair of transmission line sections electrically interconnected in series by their shield terminals. The primary signal is passed through one of the line sections, and the second section is connected to ground through a resistor. The forward voltage is thus the voltage between the shield of the first line section and ground across the second line section.

20 Claims, 3 Drawing Sheets

R-SEGMENT TRANSMISSION LINE DIRECTIONAL COUPLER

BACKGROUND OF THE INVENTION

The invention relates to directional RF couplers.

It is a common practice in the radio frequncy transmission art to use directional couplers in transmission lines to sample forward and reflected voltages on the transmission line. For example, they are often placed between a power amplifier as part of a feedback control loop to stabilize power amplifier output level under differing environmental conditions and to reduce output power in the case of a severe impedance mismatch which could cause overheating and consequent destruction of the power amplifier output devices. The latter is particularly important with modern solid state power amplifiers.

The requirements of the modern user of RF transmitting and receiving equipment dictate that RF devices, includng directional couplers, be extremely broad banded. Typical requirements of military users having electronic countermeasures and electronic counter-countermeasures applications are a bandwidth of six (6) octaves. Otherwise, multiple RF units would have to be used which would require time consuming switching and impedance matching operations and would increase the size, weight, and cost and lowr the reliability of such systems. Prior art directional couplers using transformers with metal cores or transmission line techniques are limited to a fairly narrow frequency range.

It is therefore an object of the present invention to provide an RF directional coupler having an extremely wide banwidth exceeding a 25:1 frequency range.

It is another object of the present invention to provide a broad band directional coupler having a high power handling capability.

SUMMARY OF THE INVENTION

With these and other objects in view, a broadband directional coupler for use in a circuit including a source and a load having an equivalent resistance $R_O$ is provided by first and second transmission line segments coupled in parallel and having a resistive means of value R coupled to the second line segment. The first line segment is chosen to have a characteristic impedance which is a function of $R_O$ and R, and the second line segment is chosen to have a characteristic impedance which is equl to R. Means is provided to sample an aspect of a signal appearing in the first and second line segments.

BRIEF DESCRIPTION OF THE DRAWINGS

The invention may be more fully understood by reading the following description of a preferred embodiment thereof in conjunction with the appended drawings wherein.

p DETAILED DESCRIPTION OF THE INVENTION

Figure 1:
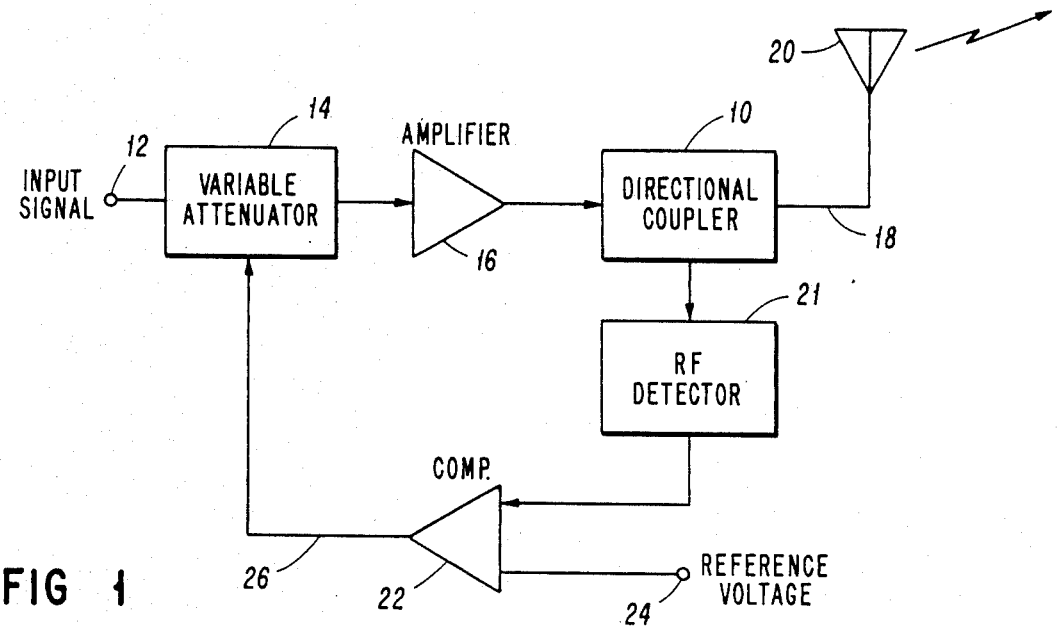
FIG. 1 is a block diagram of an RF power amplifier circuit employing a directional coupler in accordance with the present invention.

The invention may be used in connection with a circuit such as that shown in FIG. 1, which shows a directional coupler 10 in accordance with the present invention interconnected with other elements of an RF power amplifier system. A broadband RF input signal is applied at a terminal 12 to a variable attenuator, or other variable gain device 14. From variable attenuator 14 the signal is applied to a power amplifier 16 and thence to directional coupler 10. After passing through directional coupler 10, the amplified signal is coupled via a transmission line 18 to an antenna 20, from whence the signal energy is radiated into space as an electromagnetic wave.

Directional coupler 10 samples either the forward or reflected component of the RF voltage in line 10 and these voltages are detected by RF detector 21 and applied to a comparator 22 where they are compared to a reference voltage provided at terminal 24. Comparator 22 produces an error signal on line 26 which is used to control the gain (or loss) of variable attenuator 14. If directional coupler 10 samples the forward voltage on line 10, for example, a reference voltage can be chosen and applied at terminal 24 which by controlling variable attenuator 14 will maintain a fixed power output level to antenna 20, despite changes in environmental or other operating conditions, which is important in many applications. Similarly, if the reflected voltage is sensed by directional coupler 10, the gain of power amplifier 16 can be reduced to compensate for high voltage standing wave ratio conditions which otherwise could cause severe damage to amplifier 16.

Figure 2:
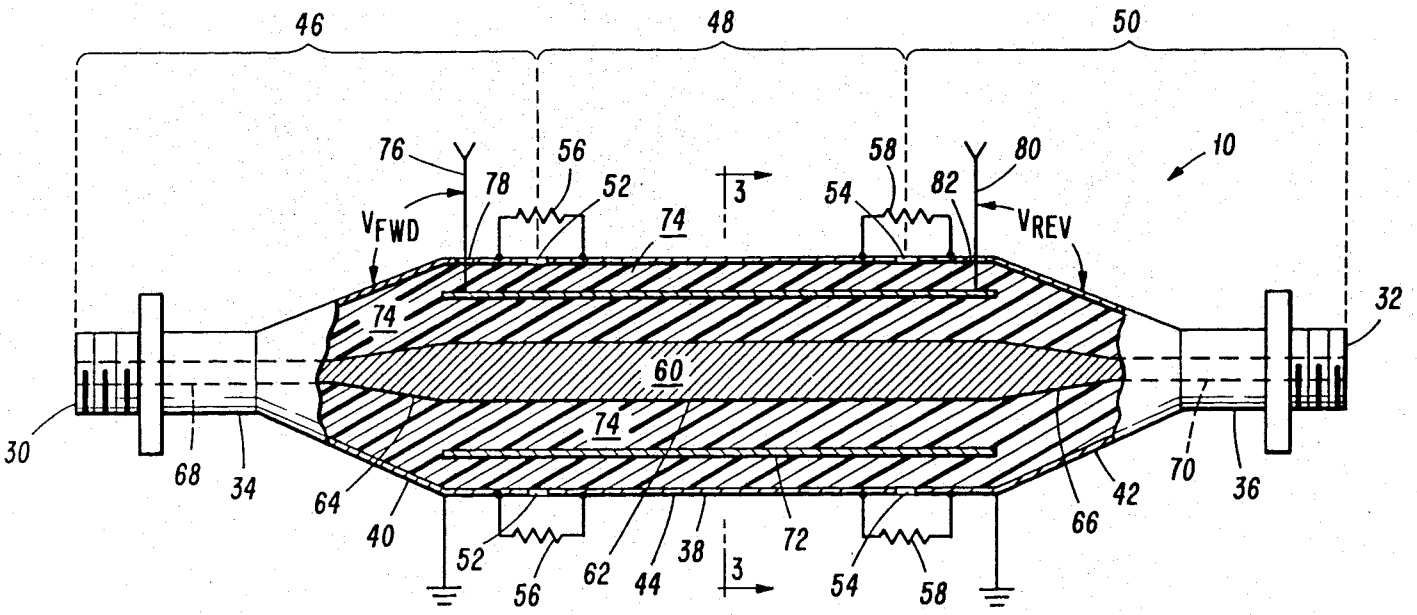
FIG. 2 is a longitudinal cross-sectional view triaxial transmission line implementation of the present invention.

Referring now to FIG. 2, a preferred specific embodiment of directional coupler 10 is show. Directional coupler 10 generally comprises a specially constructed section of transmission line having standard threaded coaxial connectors 30 and 32 on the ends thereof. Directional coupler 10 has smaller diameter end sections 34 and 36 on the ends thereof, preferably having the same diameter as coaxial connectors 30 and 32, and a center section 38 having a larger diameter than end sections 34 and 36. End section 34 and center section 38 are interconnected by a frustro-conical, or tapered, section 40, and end section 36 and center section 38 are similarly interconnected by a frustro-conical, or tapered, section 42. The diameters of sections 34, 36, 38, 40 and 42 ar sized to maintain a constant impedance throughout the length of coupler 10, according to well-known transmission line principles.

Directional coupler 10 is encased by an outer conductor, or jacket, 44 which is constructed in three electrically isolated sections 46, 48 and 50, which define a gap 52 between outer conductor sections 46 and 48 and a gap 54 between outer conductor sections 48 and 50. Outer conductor sections 46 and 48 are elecrically coupled through resistor 56, and outer conductor sections 48 and 50 are electrically coupled through resistor 58. As indicated by resistors 56 and 58, the resistors preferably circumfuse outer conductor 44 across gaps 52 and 54, respectively. Resistors 56 and 58 may be implemented as a multilicity of discrete resistors paralleled across gaps 52 and 54, with the individual resistance being chosen such that the parallel combination provides a desired effective value across gaps 52 and 54. Alternatively resistors 56 and 58 may be implemented as a single annular thin film resistor joining outer conductor sections 46 and 48 and sections 48 and 50, respectively. The placement of resistors 56 and 58 across gaps 52 and 54 is the feature which gives the invention its "R-segment" nomenclature.

Inside outer conductor 44, directional coupler 10 has a solid center conductor 60 coaxial with outer conductor 44. Center conductor 60 has a central enlarged cylindrical portion 62 bounded on each end thereof by frustro-conical, or tapered, portions 64 and 66, which are in turn bounded on each end by a smaller diameter cylindrical portions 68 and 70. The diameter of the various portions are selected such that the electrical impedance of directional coupler 10 remains constant throughout its length, which according to well-known principles is proportional to the logarithm of the ratio of the diameters of center conductor 60 and outer conductor at each point along their length.

Directional coupler 10 also has a hollow cylindrical intermediate conductor 72 surrounding center conductor 60, which is larger in diameter than center conductor 60 but smaller in diameter than outer conductor 44, and which is coaixal with both center conductor 60 and outer conductor 44. The space between center conductor 60 and outer conductor 44, between center conductor 60 and intermediate conductor 72, and between intermediate conductor 72 and outer conductor 44 is filled with an appropriate dielectric 74. In combination, conductors 44, 60 and 72 form what is commonly referred to as a triaxial transmission cable. The diameters of center conductor 60 and intermediate conductor 72 are chosen to match the electrical impedance of end sections 34 and 36 while the ratio of the diameters of intermediate conductor 72 and outer conductor 44 are chosen to provide an impedeance which matches that of resistors 56 and 58.

The length of intermediate conductor 72 is sized such that the effective length of the transmission lines formed in directional coupler 10 by intermediate conductor 72 in cooperation with center conductor 60 and outer conductor 44 are one-quarter wavelength at the center frequency of the desired bandwidth. The relationship between conductors 44, 60 and 72 and dielectric 74 is illustrated in the cross-sectional view of FIG. 3.

Intermediate conductor 72 has an electrical lead 76, representing the forward voltage sampling port, coupled to one end thereof and passing through an opening 78 in and electrically isolated from outer conductor 44. A second lead 80 representing the reflected voltage sampling port, is similarly coupled to intermediate conductor 72 on the other end thereof and passed through an opening 82 in outer conductor 44. Assuming that a transmitter is connected to connector 30 and an antenna or other load is connected to connector 32, the voltage $V_{FWD}$ between lead 76 and outer conductor section 46 is the forward voltage on the trasmission line while the voltage $V_{REV}$ between lead 80 and outer conductor section 50 is the reverse or reflected voltage on the transmission line.

Figure 4:
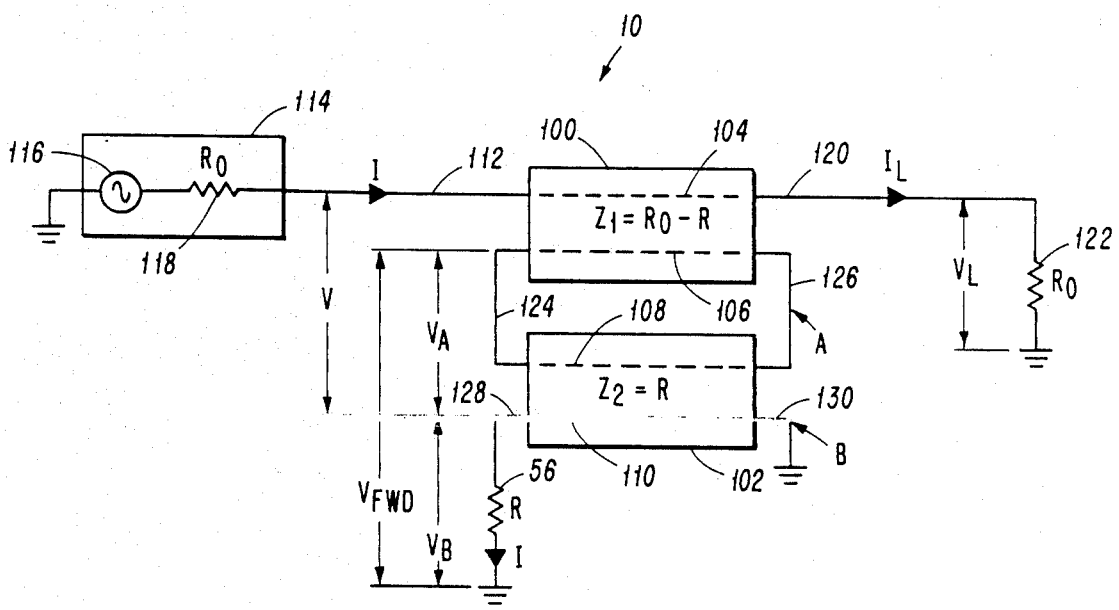
FIG. 4 is a block diagram of a flat line form of the invention.
Figure 3:
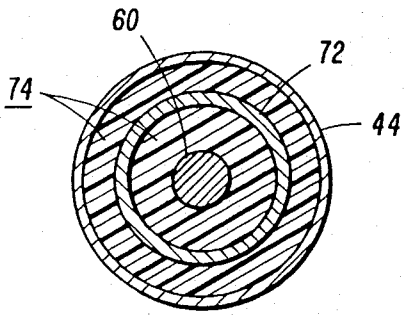
FIG. 3 is a cross-section of the embodiment of FIG. 2, taken along section line 3—3.
Figure 6:
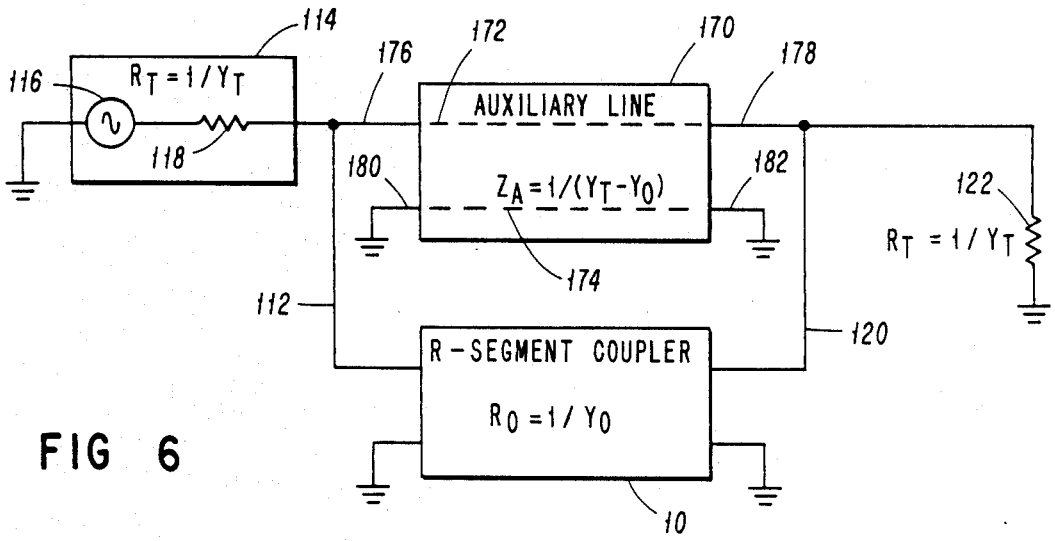
FIG. 6 is a block diagram R-segment coupler in accordance with the present invention with an auxiliary line.
Figure 5:
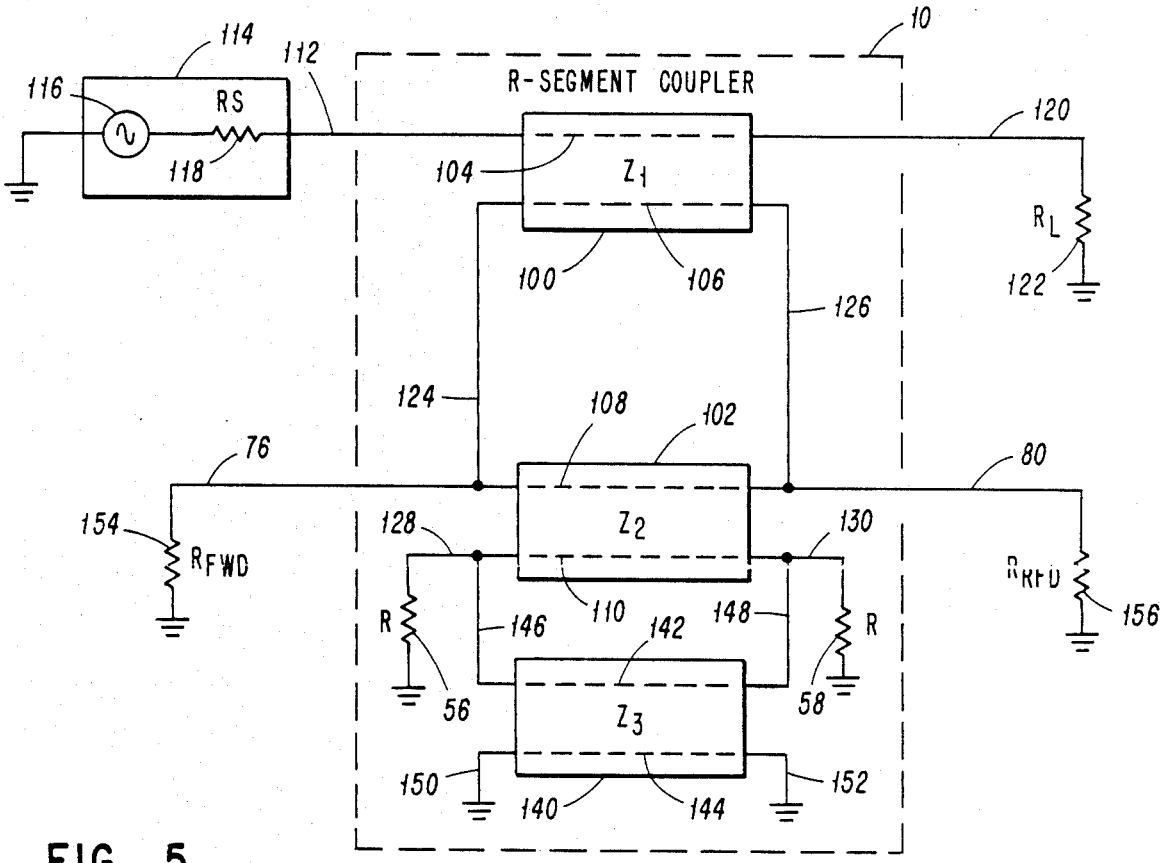
FIG. 5 is a block diagram of the flat line directional coupler as depicted in FIG. 4 but modified to account for loading and even mode impedance effects.

FIGS. 2 and 3 illustrate the invention in its coaxial cable embodiment. The invention may also be embodied in flat trnasmission lines, such as strip line. FIGS. 4–6 illustrate in electrical schematic form embodiments of the invention of the latter type. Such transmission lines are usually mathematically analyzed in their more general flat line form. FIGS. 4–6 can also be viewed as embodying electrical equivalents of the coaxial cable embodiment of FIGS. 2 and 3:

Referring now to FIG. 4, a flat line form of the directional coupler 10, which can be implemented with strip line or other transmission line techniques, is shown and will be referred to in the description of the theory of operation of the invention. While the directional coupler of the present invention is not an ideal lossless directional coupler because it requires resistance to develop part of the forward and reflected output voltages, its performance nevertheless approaches an ideal coupler with theoretical directivity of greater than 50 dB and less than 0.1 dB amplitude ripple over several decades for couplings greater than 20 dB. This exceptional performance at high couplng values is just the opposite of currently available coupler using other synthesis techniques.

It should be understood that for analytical purposes the embodiment shown in FIG. 4 illustrates only the sensing of the forward voltage $V_{FWD}$. In order to implement reverse voltage $V_{REV}$, a second resistor of value R would be coupled between point B and reference potential.

Thus, both forward and reverse voltage can be sensed in the same embodiment by including both resistor 56 and the aforementioned second resistor of value R. If sensing only the reverse voltage is desired, resistor 56 may be eliminated and only the aforementioned second resistor need be included in the embodiment. In that case the analysis of the reverse voltage would be the same as for analysis of the forward voltage as hereinafter described. Relating the voltages labeled in FIG. 4 to FIG. 2, $V_{FWD}$ has already been identified, $V_A$ is the voltage between center section 48 of outer conductor 44 and intermediate conductor 72, and $V_B$ is the voltage drop across resistor 56. Further, $Z_1$ represents the impedeance between center conductor 60 and intermediate conductor 72 while $Z_2$ represents the impedance between intermediate conductor 72 an outer conductor 44.

In generalized form directional coupler 10 can be implemented using a first transmission line segment 100 and a second transmission line segment 102. Transmission line segment 100 has two parallel conductors 104 and 106 while transmission line segment 102 has two parallel conductors 108 and 110. In a typical system the input lead 112 of transmission line segment 100 is connected to an RF generator 114 such as a power amplifier. Generator 114 may be represented as a signal source 116 having an output resistance 118 of value $R_O$. A current I flows in lead 112. Output lead 120 of transmission line segment 100 is connected to a load resistance 122 having a value $R_O$. A load current $I_L$ flows in lead 120. Conductor 106 of line segment 100 and conductor 108 of line segment 102 are connected at both ends by line 124 on its input end, and line 126 on its output end. Line 110 of transmission line segment 102 is connected on its input end 128 to resistor 56 having a value R which is tied to refernce potential on its other end. The same current I flows through resistor 56. The output end 130 of line 110 is connected to refernce potential. If $V_{REV}$ were desired, a resistor having a value R would be inserted in line 130 and $V_{REV}$ would be measured between line 126 and reference potential. In the preferrred embodiment the value of impedance $Z_2$ is chosen to be the same as R, and impedance $Z_1$ is chosen to hve a value equal to the differences between $R_O$ and R. The lengths of transmission line segments 100 and 102 are chosen to be ¼ wavelength at the frequency which is the arithmetic center of the desired bndwidth.

It should be understood by those of ordinary skill in the art that the triaxial form of coupler 10 as illustrated in FIG. 2 can be embodied as two separate transmission lines 100 and 102 connected in parallel as shown in FIGS. 4 and 5. Both lines share a common conductor which is represented as intermediate conductor 72 in FIG. 2 and as the combination of conductors 106 and 108 interconnected by lines 124 and 126 in FIGS. 4 and 5. The outer conductor section 48 in FIG. 2 is electrically equivalent to conductor 110 in FIGS. 4 and 5, and center conductor 60 in FIG. 2 is equivalent to conductor 104 in FIGS. 4 and 5. The impedance value Z1 thus corresponds to the impedeannce between center conductor 60 in FIG. 2 and intermediate conductor 72, and the impedance value Z2 corresponds to the impedance between intermediate conductor 72 and outer conductor section 48.

Turning now to the theory of operation of the invention, an ideal directional coupler is realized by sampling the voltage and current of the transmission line connected to the load terminal. The line voltage V and current I are defined in terms of forward (+) and reflected (−) phasors as below:

$$V = V^+ + V^- \text{ and } \frac{I = V^+ - V^-}{Z_0}$$

$Z_O = R_O$ = Characteristic impedance of the measurement system.

To achieve infinite directivity, the forward output port must be independent of the reflected term in the above equation (i.e., $V^-$). Although the reverse must also be true, it is assumed for simplicity that only a forward output port is desired.

This ideal directive property of the R-segment coupler shown in FIG. 4 is accomplished by adding the voltage across resistor 56 ($V_B$) to the voltage across the bottom transmission line ($V_A$). The resultant sum of ($V_A$) and ($V_B$) is the desired forward port voltage ($V_F$) $=2\ V^+R/R_O$ as shown below. However, note that the ratio of $R/R_O$ must be small to prevent excessive mismatch at the input.

The preferred range of $R/R_O$ is less than 0.05 which corresponds to approximately 20 dB coupling.

$$V_A = V * R/R_0 = (V^+ + V^-) * R/R_0$$

$$V_B = I * R = (V+ - V^-) * R/R_0$$

$$V_F = (V^+ + V^- + V^+ - V^-) * R/R_0 = 2 * V^+ * R/R_0$$

If desired, a reflected port can be added to the above schematic by inserting a resistor of value R between line 130 and ground. The reflected output would then be between the line 126 and ground. Although the coupler directivity is poor at very low frequencies or at multiples of the half wave frequency, it is typically very acceptable over extremely wide bandwidths.

For example, consider a coupler with a value of $R=0.5$ ohms and $R_O=50$ ohms. The resultant forward voltage is approximately 20 log $(2R/R_O) = -34$ dB below the output voltage. Analysis of this coupler shows a directivity greater than 40 dB from 1 to 49 percent wave lengths. The forward voltage ($V_{FWD}$) variation is less than 0.2 dB over this 49:1 frequency ratio.

Although the schematic of FIG. 4 and the above derivation are useful for understanding the inherent broadband characteristics of the R-segment coupler, actual realizations typically include loading at the forward and reflected ports as well as even mode impedances between the ground plane and the floating return of the transmission line $Z_2$.

These additional considerations are taken into account in FIG. 5. The schematic is essentially the same as that of FIG. 4 except for several additions. A transmission line segment 140 having an impedance $Z_3$ is added to represent even mode impedance (i.e., the electrical interaction between the outer conductor 44 and the ground plane). Line segment 140 can be reprsented as having two conductors 142 and 144, the input 146 of conductor 142 being coupled to input end 128 of conductor 110 in line segment 102, the output 148 of the same conductor being coupled to the output end 130 of conductor 110 in line segment 102, and the input end 150 and the output end 152 of conductor 144 in line segment 140 being coupled to reference potential. In addition, a resistor 154 having a value $R_{FWD}$ and coupled to refernce potential is added to represent the load on forward port 76, and resistor 156 having a value $R_{RFD}$ and coupled to reference potential is added to represent the load on reflected port 80. Also shown is resistor 58 which has a value R and implements the reflected voltage sampling aspect of the invention as previously discussed. Finally, the value of source load resistor 18 is given as the value $R_S$, and the output load resistor 122 is given the value $R_L$. For a coaxial realization, it is assumed that $Z_1$ is within the inner conductor of $Z_2$, and $Z_2$ is within the inner conductor of $Z_3$. Therefore, only one even mode impedance ($Z_3$)is necessary in the model.

Even though the coupler can be realized without reflected port 80, a realization can be balanced easier for the effects of the port loading, even mode impedance, and parasitics when there is a pane of symmetry through the center of the coupler. The equations given below are exact solutions for realizing infinite directivity at the ¼ wave frequency with finite values for port loading and the even mode impedance. It should be emphasized that although the even mode impedance is normally a detriment to transmission line realizations, $Z_3$ is here used to re-establish infinite directivity when a finite resistance is used on the forward and reflected ports.

For purposes of the ensuing discussion, the following component values are defined:

$$Z_1 = R_0 - R \text{ (ohms)}$$

$$Z_2 = R \text{ (ohms)}$$

$$R_S = R_0 \text{ (ohms)}$$

$$R_L = R_0 \text{ (ohms)}$$

$$R_{FWD} = R_0 - R \text{ (ohms)} \quad \text{(see note below)}$$

$$R_{RFD} = R_0 - R \text{ (ohms)} \quad \text{(see note below)}$$

$$Z_3 = R_0 - R \text{ (ohms)} \quad \text{(see note below)}$$

NOTE: $R_{FWD}$, $R_{RFD}$ and $Z_3$ can be set equal to $R_O$ and still achieve excellent performance.

The variable definitions used in the ensuing discussion are defined as follows:

| | | |
|---|---|---|
| $P$ | = | Magnitude of the load reflection coefficient |
| $R$ | = | Current sample resistor (ohms) |
| $R_L$ | = | Load resistor (ohms) |
| $R_S$ | = | Source resistor (ohms) |
| $R_0$ | = | Nominal load and source resistor (ohms) |
| $Z_1$ | = | Impedance of high impedance transmission line (ohms) |
| $Z_2$ | = | Impedance of low impedance transmission line (ohms) |
| $Z_3$ | = | Even mode equivalent transmission line (ohms) |

$$PG_{output} = \frac{\text{power delivered to the output port}}{\text{power available at the source port}} \quad (1)$$

$$PG_{output}\,(\text{db}) = 20 \log \left\{ \frac{2(R0 - R)[R_0^2 - R(R_0 - R)]}{R_0\,[R_0^2 - (R_0 - R)^2]} \right\} \quad (2)$$

$$PG_{forward} = \frac{\text{power delivered to the forward port}}{\text{power available at the source port}} \quad (3)$$

$$PG_{forward}\,(\text{db}) = 10 \log \left\{ \frac{4(R_0 - R)\,R^2}{R_0^3} \right\} \quad (4)$$

$$PG_{reflected} = \frac{\text{power delivered to the reflected port}}{\text{power available at the source port}} \quad (5)$$

$$PG_{reflected}\,(\text{db}) = PG_{forward}\,(\text{db}) + 20 \log (P) \quad (6)$$

Nominal power dissipated in R($P_R$) is approximately:

$P_R$=[nominal load power]* $R/R_O$

It should be noted that the dissipation can approach 4*$P_R$ for certain phases of infinite load VSWR. The dissipation for a 2:1 VSWR load is less than 1.78 $P_R$.

Although the design equations are only exact at the center frequency of the bandwidth, it can be shown by computer analysis that high directivity and low variations in the coupled outputs can be maintained for an extremely wide bandwidth.

Using the design criteria of the present invention bandwidths of 50:1 are possible with high values of coupling with low loss and high directivity. To decrease the dissipation in the coupler for a given value of series resistance (resistor 56 or 58 in FIG. 5), an auxiliary parallel transmission line $Z_A$ can be used as shown in FIG. 6. This configuration not only decreases the dissipation for a given value R but also allows use of higher $Z_O$'s in the R-segment coupler. It is best suited for strip lines where the top ground plane is used for $Z_A$ and the bottom contains the R-segment coupler.

Referring specifically to FIG. 6, R-segment coupler 10 is shown connected to signal source 14 on its input line 112 and to load resistor 122 on its output line 120. The source and output load resistors 118 and 122 are given a value $R_T$. Coupler 10 has connected in parallel an auxiliary transmission line 170 having parallel conductors 172 and 174. The input 176 of conductor 172 is coupled to resistor 118 while the output 178 is connected to resistor 122. The inputs 180 and output 182 of conductor 174 are coupled to reference potential.

The R-segment coupler in FIG. 6 is designed by assuming the load and source ports are equal to $R_O$=1-/$Y_O$. This impedance can be assigned any practical value higher than the load/source resistors $R_T$. It follows that the main transmission line ($Z_A$)=1/($Y_T$−$Y_O$).

Substituting 1/$Y_O$ for $R_O$ in equations (1)–(6) above yields the following design equations:

$$PG_{output}\,(\text{db}) = 10 \log 1 - \frac{2_T R * R}{R_0^2}$$

$$PG_{forward}\,(\text{db}) = 10 \log \frac{4(R_0 - R)\,R^2 * R_T}{R_0^4}$$

$$PG_{reflected}\,(\text{db}) = PG_{forward}\,(\text{db}) - 20 \log (P)$$

Nominal power dissipated in $R$ ($P_R$) is approximately:

$$P_R = [\text{nominal load power}] * R * RT/R_0^2$$

It should be noted that the dissipation can approach 4*$P_R$ for certain phases of infinite VSWR. The dissipation for a 2:1 VSWR load is less than 1.78 $P_R$.

A possible source of high fequency degradation is parasitic inductance in series with the two R's. By analysis it can be shown that the inductive reactance should be lower than 0.1 R at the ½ wave length frequency. To avoid this problem, either several resistors must be connected in parallel, or ideally a thin film of resistive material should be directly deposited on an insulator ring that connects in series with the outside shield conductor. If chip resistors are used they should be soldered completely around the circumference to avoid interruptions in the surface current which creates inductance anomalies. A limited amount of correction is possible if capatitance is shunted across the resistor; however, it is best to either use a full complement of shunt resistors or deposit the resistance around the circumference.

Finally, variations of the line impedance over its length can cause degradation of the high frequency performance. Changes in impedances should be less than one percent to prevent serious degradation over the upper half of the bandwidth. Ideally, the coupler should use homogeneous dielectrics for all lines with precision spacing of the conductor surfaces.

While particular embodiments of the invention have been shown and described, it is obvious that minor changes and modifications may be made therein without departing from the true scope and spirit of the invention. It is the intention in the appended claims to cover all such changes and modifications.

We claim:

1. A broadband directional coupler for use in a circuit including a signal source and a signal load each having an equivalent resistance of value $R_O$, comprising:

a first transmission line segment comprising first and second conductors connected to the signal source and load;

a second transmission line segment adjacent said first transmission line segment, comprising third and fourth conductors connected in parallel to the first transmission line segment, said second conductor in said first transmission line segment being coupled to said third conductor in said second transmission line segment to form a common conductor;

resistive means of value R connected to said fourth conductor;

means connected to said common conductor for sampling an aspect of a signal therein;

said first transmission line segment having characteristic impedance which is a function of $R_O$ and R; and said second transmission line segment having characteristic impedance which is a function of R.

2. A broadband directional coupler as recited in claim 1 wherein the impedance of said first transmission line segment is equivalent to ($R_O - R$), and the impedance of said second transmission line segment is equivalent to R.

3. A broadband directional coupler as recited in claim 2 wherein said sampling means comprises:

a first terminal connected to a first end of said common conductor in said first transmission line segment; and a second terminal connected to a second end of said common conductor in said first transmission line segment.

4. A broadband directional coupler as recited in claim 3 wherein said resistive means comprises:

a first resistor connected to the first end of said fourth conductor; and a second resistor connected to the second end of said fourth conductor.

5. A broadband directional coupler as recited in claim 4 further including a third transmission line segment connected to said first and second transmission line segments.

6. A broadband direction coupler as recited in claim 4 wherein said first and second transmission line segments comprise a single triaxial transmission line segment having a center conductor, an outer conductor and an intermediate conductor, said intermediate conductor serving as said common conductor.

7. A broadband directional coupler as recited in claim 6 wherein the outer conductor of said triaxial transmission line segment is comprised of first, second, and third electricaly isolated sections; said first and second sections are connected through said first resistor; and said second and third sections are connected through said second resistor.

8. A directional coupler, comprisng:

first transmission line segment having first and second conductors, each conductor having an input and an output terminal, said input terminal of the first conductor being adapted to receive signals from preceding circuiry and said output terminal of said first conductor being adapted to apply said signals to subsequent circuitry;

a second transmission line segment having first and second conductors, each conductor having an input and an output terminal;

first means for coupling the input terminal of said first condcutor of said second line segment to the input terminal of said second conductor of said first line segment; and second means for coupling the output terminal of said first conductor of said second line segment to the output terminal of said second conductor of said first line segment; and resistive means coupled to said input terminal of said second conductor of said second line segment.

9. A directional coupler as recited in claim 8 wherein:

the impedance of said second line segment at the mathematical center of the desired bandwidth of said directional coupler is equal to the value of resistance of said resistive means; and the impedance of said first line segment is equal to the difference between the equivalent resistance of the circuitry to which said input and output terminals of said first conductor of said first transmission line are coupled and said resistance value of said resistive means.

10. A directional coupler as recited in claim 9 further including second resistive means coupled to the output terminal of said second conductor of said second line segment.

11. A directional coupler as recited in claim 10 further including means coupled to said first coupling means for sampling an aspect of the signal thereon.

12. A dirctional coupler as recited in claim 11 further including means coupled to said second coupling means for sampling an aspect of the signal thereon.

13. A directional coupler, comprisng:

an elongated conductor;

a first tubular conductor coaxal with the said elongated conductor;

a second tubular conductor larger in diameter than the first tubular conductor and coaxial with both said elongated conductor and the first tubular conductor, said second tubular conductor comprising first and second electrically-isolated sections;

resistive means coupling the first and second sections of said second tubular conductor; and means electrically isolated from said second tubular conductor for sampling an aspect of a signal appearing on said first tubular conductor at a first location.

14. A directional coupler as recited in claim 13, wherein said second tubular conductor further includes a third electrically isolated section and further including resistive means coupling said second and third section of said second tubular conductor.

15. A directional coupler as recited in claim 14 further including means electrically isolated from said second tubular conductor for sampling an aspect of a signal appearing on said first tubular conductor at a second location.

16. A directional coupler as recited in claim 15 wherein said first location associated with said first recited sampling means is at a first end of said first tubular conductor and said second location associated with said second recited sampling means is a second end of said first tubular conductor.

17. A directional coupler as recited in claim 16 wherein said first and second resistive means each comprises a plurality of discrete resistors coupled in parallel between said first and second sections of said second tubular conductor.

18. A directional coupler as recited in claim 17 further including coaxial input means, comprising:

a center conductor coupled to said elongated conductor; and a tubular outer conductor coupled to said second tubular conductor.

19. A directional coupler as recited in claim 18 further including coaxial output means, comprising:

a center conductor coupled to said elongated conductor; and a tubular outer conductor coupled to said second tubular conductor.

20. A directional coupler as recited in claim 19 wherein said first and second resistive means each comprises an annular resistor coupled between said first and second sections of said second tubular conductor.

* * * * *